United States Patent [19]

Usui et al.

[11] 4,453,645

[45] Jun. 12, 1984

[54] ADJUSTABLE MULTI-COMPARTMENTED CONTAINERS

[75] Inventors: Toshihiro Usui; Kiyoshi Inomoto, both of Utsunomiya, Japan

[73] Assignee: Fuji Heavy Industries, Ltd., Tokyo, Japan

[21] Appl. No.: 323,125

[22] Filed: Nov. 19, 1981

[30] Foreign Application Priority Data

Nov. 25, 1980 [JP] Japan ..... 55-165496

[51] Int. Cl.[3] ..... B65D 25/06; B65D 88/32

[52] U.S. Cl. ..... 220/22; 220/20.5; 220/85 B; 222/386.5

[58] Field of Search ..... 220/20.5, 22, 22.1, 220/85 B; 222/95, 96, 386.5

[56] References Cited

U.S. PATENT DOCUMENTS

| | | | |
|---|---|---|---|
| 3,172,556 | 3/1965 | Stiefel | 220/22 |
| 3,351,235 | 11/1967 | Paton | 220/22 |
| 3,432,064 | 3/1969 | Tenpas | 220/22 |
| 3,583,330 | 6/1971 | Freudman | 220/85 B |
| 3,918,604 | 11/1975 | Kersten | 220/85 B |
| 4,114,776 | 9/1978 | Plass | 220/20.5 |

FOREIGN PATENT DOCUMENTS

| | | | |
|---|---|---|---|
| 2263948 | 10/1975 | France | 220/85 B |
| 55-16181 | 2/1980 | Japan . | |

*Primary Examiner*—George E. Lowrance

*Attorney, Agent, or Firm*—Fitzpatrick, Cella, Harper & Scinto

[57] ABSTRACT

The container is constructed so as to provide a plurality of compartments in the container body, in which the load is filled. The compartments are defined by an elastic membrane element so that the membrane elements can be expanded so as to provide a wider space particularly for the compartment formed by the membrane elements. The partition or partitions formed by the elastic membrane element are operated to move to a predetermined position by manual or mechanical means disposed outside the container so that the operation is rendered easy. The container body is provided a supporting element for resting the partitions so that the downwardly inclined slopes are provided so as to slide the load downward easily. Under the supporting element is also provided a bottom portion which can also be utilized for accommodating the load.

The container of the construction can transport different kinds of loads on back and forth transportation. It also can provide a wider space for the load and enable an easy operation for loading and unloading.

3 Claims, 15 Drawing Figures

FIG.7A
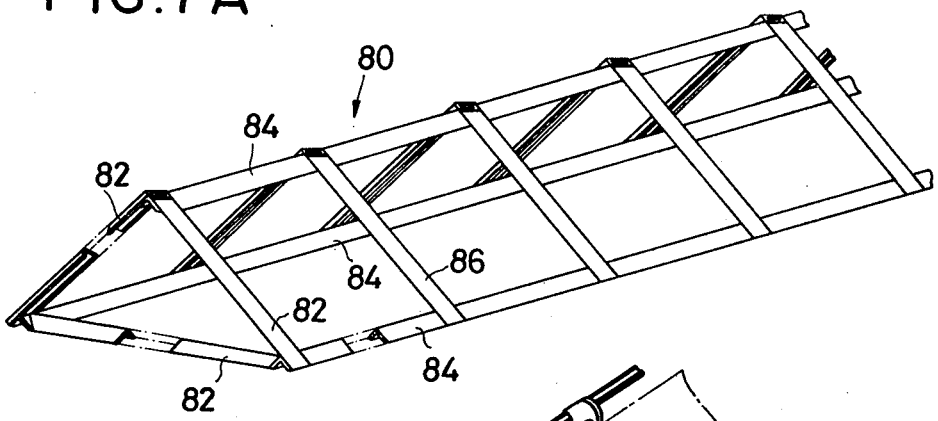
FIG.7B
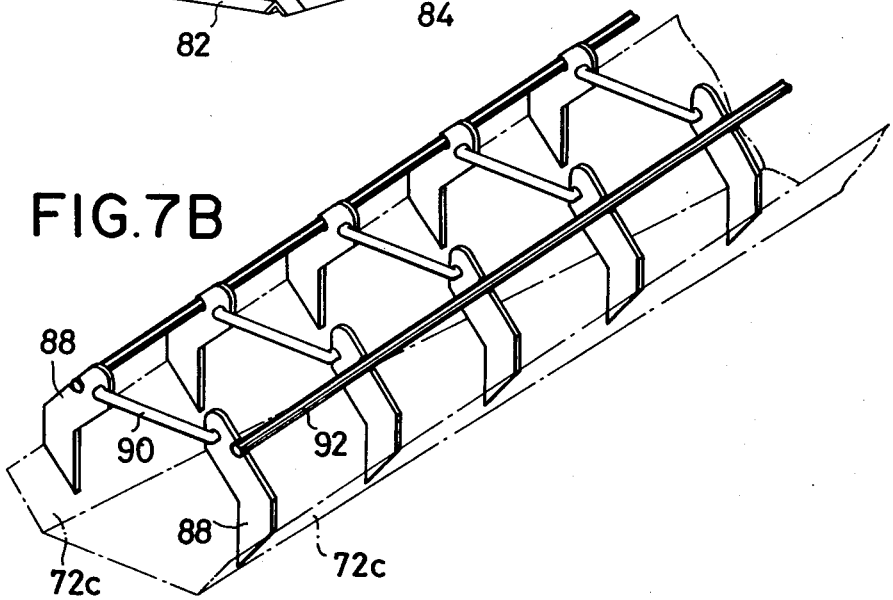
FIG.8B
FIG.8A
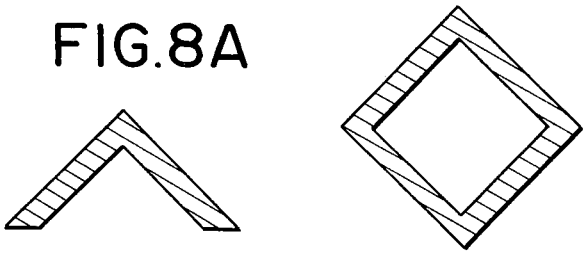

ADJUSTABLE MULTI-COMPARTMENTED CONTAINERS

BACKGROUND OF THE INVENTION

1. Field of the Invention

The present invention relates to a container and, more particularly, to a multi-purpose container capable of transporting both a one-way bulk powdered and granular load and a one-way liquid load. The container is suitable for use on rail, road or sea, and it can be constructed so as to be suitable for rail, road or sea transport.

2. Brief Description of the Prior Art

Conventional bulk containers have limited use. Such containers have been constructed so as to be suitable exclusively for one goods or commodities, such as coal, cement, oils or the like. In instances where a railroad car carrying such conventional container transports heavy oils from the oil station to a cement factory, a suitable powdered good return load is not available so that it should travel back from its original destination empty. This is extremely ineconomical from the point of view of operating transportation and saving labor.

It is known of a multi-purpose container such as a hopper, a tank or any other container or receptacle, in which the container body is divided into a plurality of compartments by means of a movable membrane element or elements and in which the membrane element is constructed so as to move towards a predetermined position to provide a necessary space for the compartment into which goods or commodities are loaded. Such containers are generally provided with an inverted V-shaped bottom so as to slide the load downwardly along the both inclined or sloped side surfaces of the upwardly raised central bottom portion in air slide discharge manner and discharge it from an outlet situated at the lowest points of the bottom. This construction, however, gives a dead space under the upwardly raised central bottom portion so that an efficiency in loading is encountered.

It has also been proposed in Japanese Patent Application No. 16,181/1980 that the container body is divided into plural compartments by means of a rubber element, in which the compartment to be loaded therein is constructed so as to expand and accommodate the load by the introduction of compressed air. The container of this type can transport different kinds of liquids or powdered materials or a combination of a liquid with a powdered or granulated commodities as back and forth loads so that it can provide a favorable transportation efficiency. This construction, however, presents a drawback that a manhole for filling or loading bulk powdered or granular commodities cannot be rendered large because the compartment for the load is constructed in air-tight manner so as to expand the rubber element by means of compressed air. A small manhole requires a laborious operation for loading bulk materials and consequently a longer time for loading. Although it is possible to render the manhole larger by providing it with a lid, various problems will be encountered that the weight of the lid should be increased to stand against the pressure applied by the compressed air and that the air-tight structure is accordingly rendered complicated.

OBJECTS AND SUMMARY OF THE INVENTION

Therefore, an object of the present invention is to provide a container designed so as to be capable of loading different kinds of loads particularly on back and forth transportation.

Another object of the present invention is to provide a container having openings designed for the easy loading of bulk powdered or granular commodities or goods and for liquid material.

A further object of the present invention is to provide a container that gives no dead space particularly at the bottom portion of the container body.

A still further object of the present invention is to provide a container adaptable readily to transport on rail, road or sea.

In accordance with one aspect of the present invention, there is provided a container comprising (a) a container body having a plurality of compartments; (b) a partition or a plurality of partitions disposed movably in the container body so as to define the compartments; (c) a supporting means for supporting the partition or partitions so as to allow the partition or partitions to rest thereon and for providing a further space for accommodating commodities or goods therein; (d) a means for rotating the partition or partitions whereby the compartment or compartments sought to be loaded is or are constructed so as to give a wider space for accommodating the commodities or goods therein; (e) said supporting means arranged so as to rest the partition or partitions thereon whereby an inclined surface is provided to easily slide downward the commodities or goods; and (f) said partition or partitions arranged so as to expand and provide a wider space when the compartment or compartments defined thereby is filled with the commodities or goods.

BRIEF DESCRIPTION OF THE DRAWINGS

FIGS. 7A and 7B are each a perspective view illustrating the frame to be disposed in the container body.

FIGS. 8A and 8B are each a cross sectional view illustrating the bar element constituting the frame of FIG. 7A.

DETAILED DESCRIPTION OF THE PREFERRED EMBODIMENTS

A description will now be given of the container of the invention which is constructed so as to be adaptable particularly as a railroad car for carrying liquid materials as well as bulk powdered or granular commodities or goods such as coal or cement.

Figure 1A:
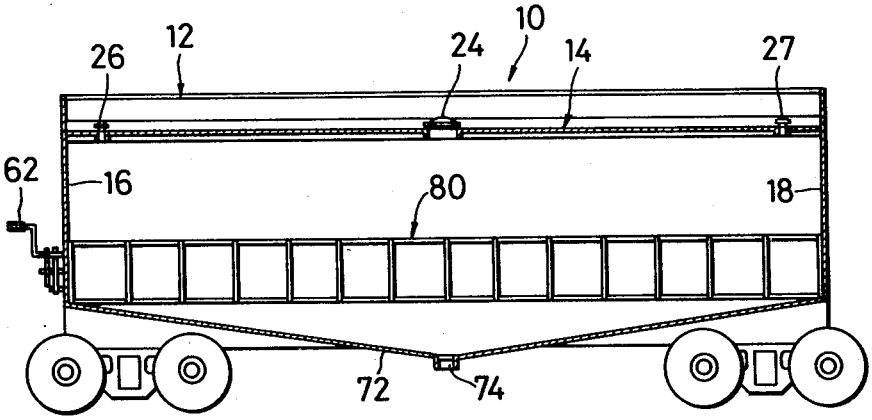
FIG. 1A is a cross section illustrating an example of the container in accordance with the present invention, when applied to a railroad car.
Figure 1B:
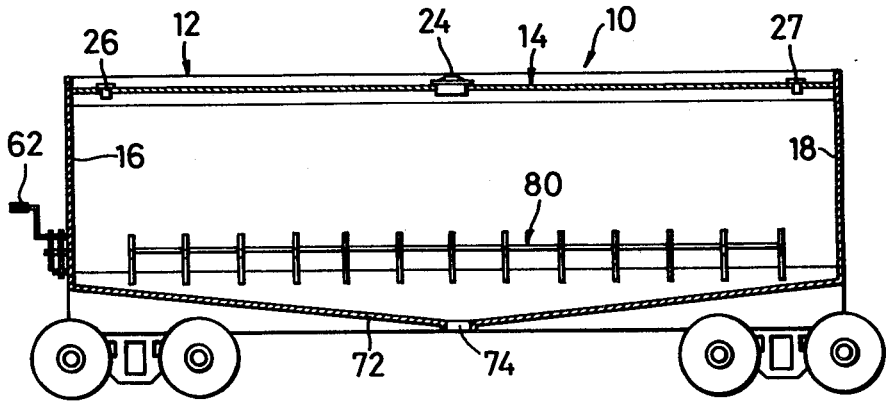
FIG. 1B is a cross section illustrating another example of the container in accordance with the present invention, which is applied to a railroad car.
Figure 2:
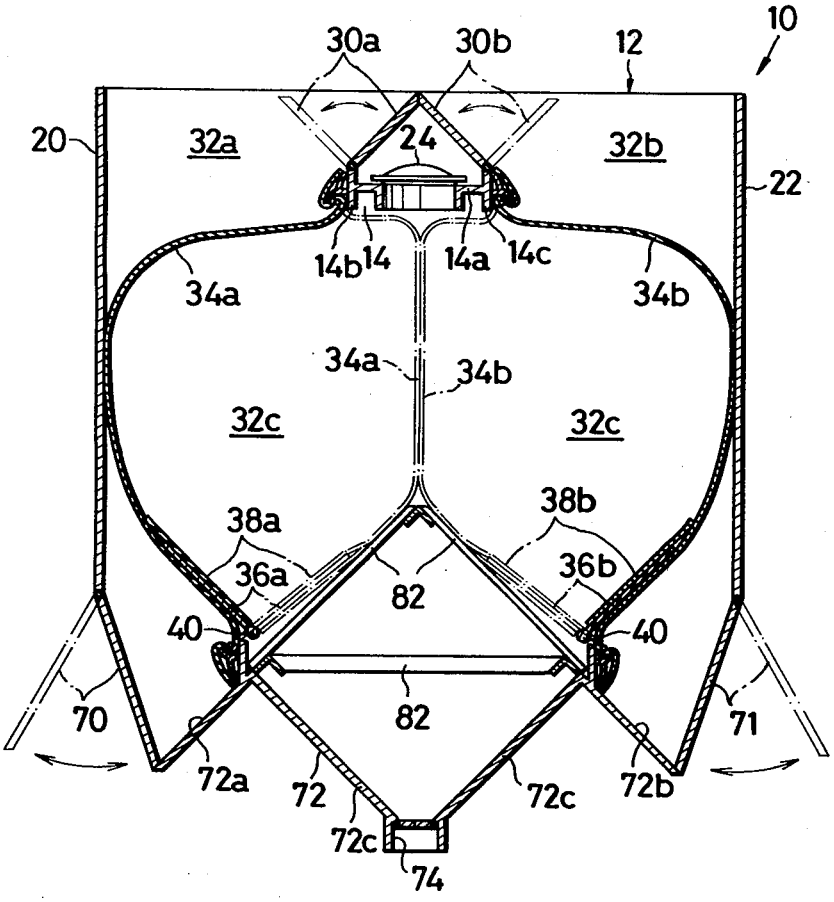
FIG. 2 is a cross sectional view illustrating the container body of the container of FIG. 1.

Referring to FIGS. 1A and 1B, the container in accordance with the present invention may be seen to comprise a large rectangular body 10 having a top portion 12 that may be open. The container body 10 is provided at the upper part thereof with a support 14 which extends over substantially the whole length from a left wall 16 to a right wall 18 and at the central portion between a left side wall 20 and a right side wall 22, as best shown in FIG. 2, and the support is secured to the front wall and the rear wall. The support is further provided with a manhole 24 for filling or loading commodities or goods at the center between the left wall and the right wall and with a vent or vents 26 and 27 between the front and/or rear walls and the manhole.

Figure 9:
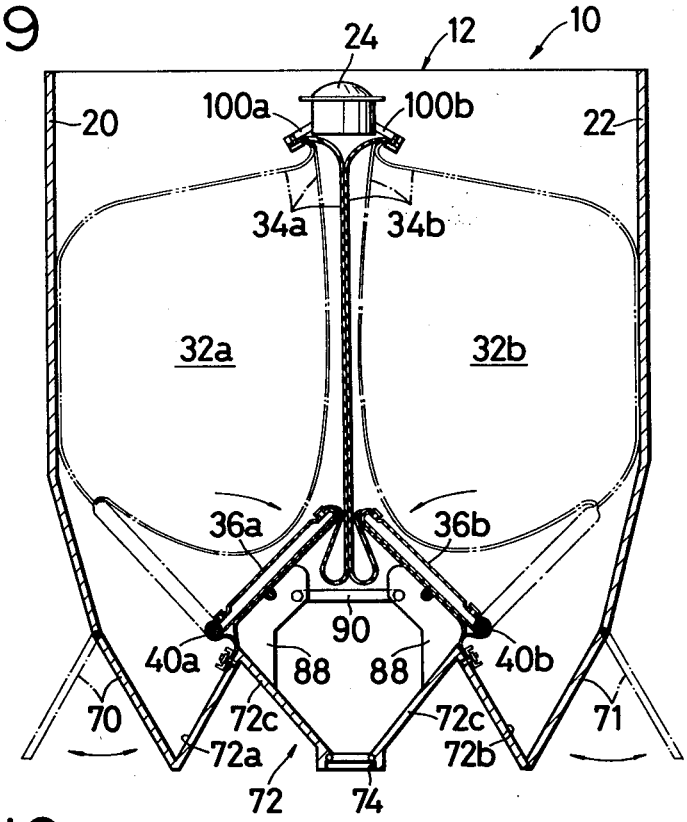
FIG. 9 is a cross sectional view illustrating the container body of FIG. 1B, in which the side compartments are loaded and filled.
Figure 10:
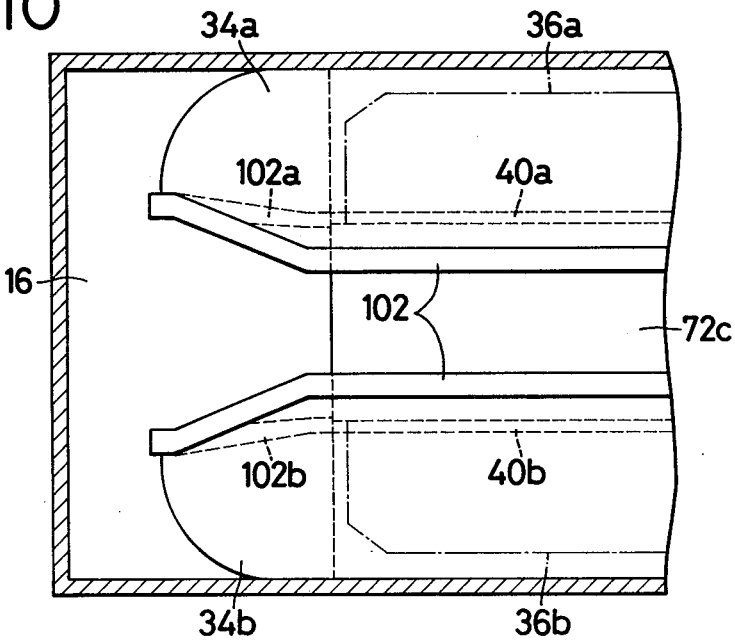
FIG. 10 is a cross sectional view illustrating a variation of the container body in which the body has inclined front and rear walls.

Referring now to FIG. 2 in particular, the support 14 comprises a horizontal connection plate element **14*a* and a pair of side plate elements 14*b* and 14*c* connected vertically to the both ends of the connection plate element so as to form an H-shaped cross sectional structure. The support is also provided over the top thereof and through substantially the whole length thereof with a pair of plate members 30*a* and 30*b* which are hinged to the respective side plate elements 14*b* and 14*c* of the H-shaped support. The plate members, generally referred to as 30, are disposed so as to abut each other at the free ends and form an inverted V-shaped cross-sectional structure at the closed position, whereby they serve as distributing the bulk powdered or granular commodities or goods through the open top portion 12 into side compartments disposed at the both sides of the plate members 30. Where goods or commodities are to be filled or loaded in the side compartments, the plate members 30 are closed so as to form the inclined surfaces over which the goods are readily slided and loaded therein. Where goods or commodities are to be filled in the compartment disposed at the middle portion of the container body, the plate members 30 are opened so as to expose the manhole 24 through which the filling or loading is carried out, as shown by dot-dash lines in FIG. 2. The plate members 30 may be integrally formed with the support or may be detachably mounted thereto. As shown in FIGS. 9 and 10, a plate member, generally referred to as 100, comprising a pair of plate member portions 100*a* and 100*b* having an inverted V-shaped cross section, when taken together, may be employed as a substitute for the H-shaped support 14. The plate member 100 can function as supporting partition or partitions for dividing the container body 10 into a desired number of compartments where to load and fill commodities or goods, and simultaneously can serve as distributing the load into the side compartments disposed at the both sides of the plate member 100. It is also possible to mount a pair of plate member portions 100*a* and 100*b* on the support 14** so as to provide downwardly inclined slopes over which the load is readily slided downward into the side compartments.

Figure 3:
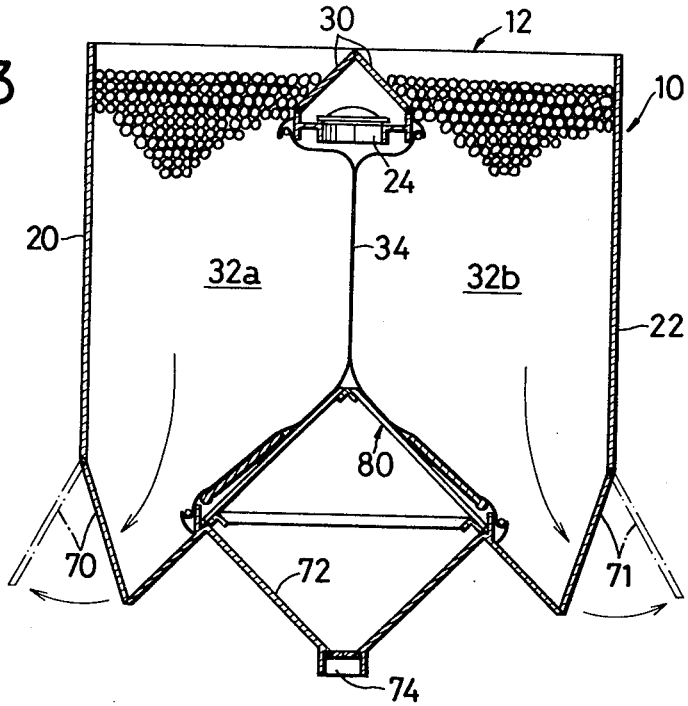
FIG. 3 is a cross sectional view illustrating the container body of FIG. 2, in which the side compartments are loaded and filled.
Figure 4:
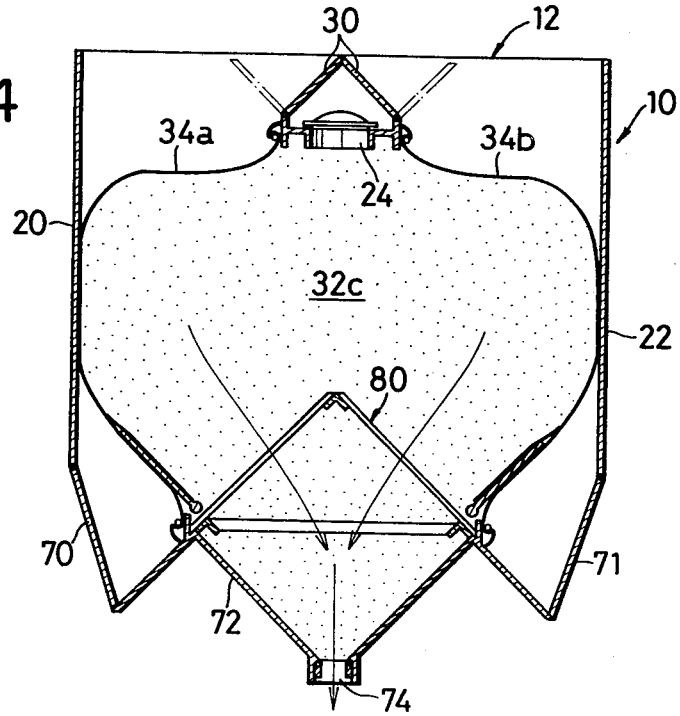
FIG. 4 is a cross sectional view illustrating the container body of FIG. 2, in which the central compartment is loaded and filled.

Referring further to FIGS. 2 through 4, the container body 10 may be divided into a desired number of compartments. Although an example taken from the container body having three compartments will be given hereinbelow, it should be noted that there is no intention to restrict the invention to any particular feature. The container body 10 shown therein may be seen to comprise two side compartments **32*a* and 32*b* separated by a pair of partitions 34*a* and 34*b*, and a central compartment 32*c* defined thereby. The partition, generally referred to as 34, may be of any material such as a material such as rubber or any other elastic material, which is resistant to goods or commodities to be filled and unharmed thereby. The top portions of the partitions may be supported by and secured to the H-shaped support 14, as shown in FIGS. 2 through 4, or the inverted V-shaped plate member 100, as shown in FIGS. 9 and 10, and the bottom portions thereof are secured to a bottom plate element in a manner as will be in detail described. The side ends of the partitions may be secured to projections or fastening means (not shown) formed on the front wall 16 and the rear wall 18. It is preferred to construct the side compartments 32*a* and 32*b* so as to be suitable for the loading and filling with bulk powdered or granular commodities or goods such as coal, as shown in FIG. 3. In instances where the central compartment 32*c* is intended to be filled particularly with liquid load or finely divided good load, as shown in FIG. 4**, the central compartment should be constructed in substantially liquid-tight manner so that the connection of the partitions to both the walls and the bottom of the container body should be effected so as to prevent the liquid or finely divided load from being leaked therefrom.

Figure 5A:
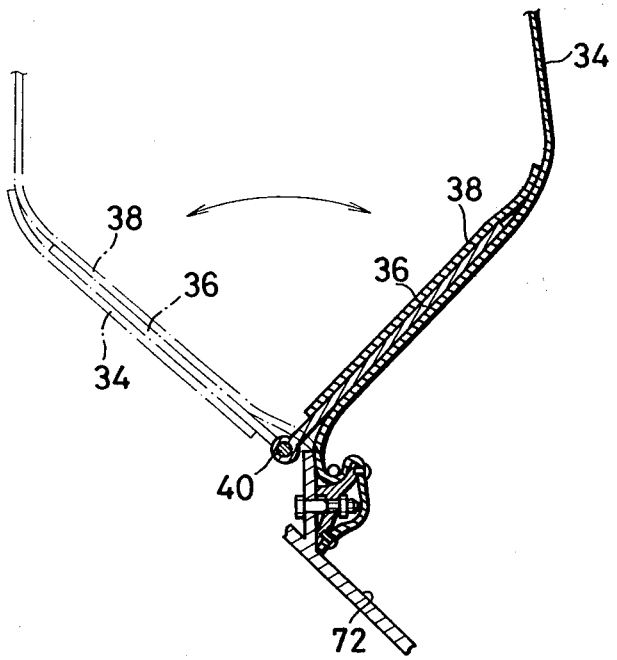
FIGS. 5A and 5B are each a cross sectional view illustrating the construction of the hinge plate.
Figure 5B:
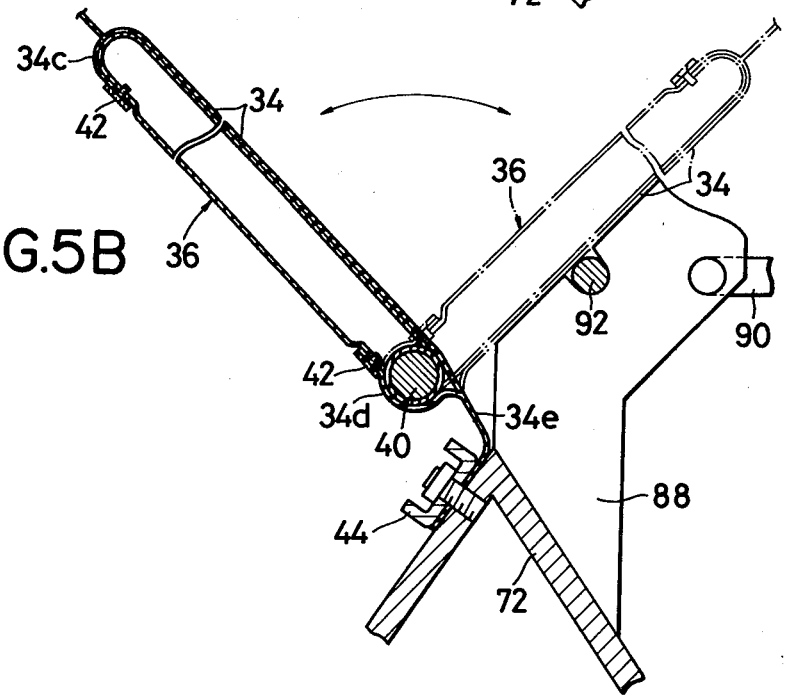

Turning now to FIGS. 5A and 5B, the lower end portion of the partition 34 is secured to a bottom plate member as will be described hereinafter. The partition is further connected to a hingedly movable plate (hereinafter will also be referred as the hinge plate) 36. The connection of the hinge plate to the partition may be effected in any conventional manner and it is noted that the partition should be connected to the hinge plate to ensure that the partition is rotated in association with the rotation of the hinge plate. As shown in FIG. 5A, the hinge plate 36 is inserted into a cavity formed between the partition 34 and a secondary partition member, generally referred to as 38. The secondary partition may be of the same material as the partition 34. In this case, the secondary partition member is connected at the top portion thereof to the inner surface of the partition 34 so as to form the cavity into which the hinge plate 36 is inserted. The hinge plate is securedly connected to a shaft, generally referred to as 40, by means of any conventional means such as welding, so that the partition can be moved towards a predetermined position, for example, as shown by dot-dash lines in FIG. 5A. Referring now to FIG. 5B, the lower end portion of the partition 34 may be joined to the hinge plate 36 movable pivotably together with the shaft 40 by means of an exterior force. The hinge plate 36 shown in FIG. 5B is constructed so as to form a hollow U-shaped panel, and the free ends of the U-shaped hinge plate is then connected by conventional means such as welding to the shaft 40 of, for example, a stainless steel. The partition is then disposed so as to thoroughly cover the surface of the hinge plate facing the central compartment into which particularly a liquid load is filled. In this case, in order to prevent the liquid or finely divided load from being leaked from the connection between the partition and the hinge plate, it is preferred that the partition is arranged so as to partially cover the top portion of the hinge plate and the bottom portion of the shaft 40 connected integrally thereto. To this end, a pair of partition elements 34c and 34d are provided on the back of the partition so as to cover the both ends of the hinge plate 36, and the both top portions of the partition elements are secured to the hinge plate by means of any conventional connection means such as bolts or screws, generally referred to as 42. The lower portion of the partition 34 further extends downwardly to a bottom plate member, and the extension partition element 34e thereof is secured to the bottom plate member by any conventional connection means such as a bolt or screw 44. In both cases, as the shaft 40 is rotated in virtue of an exterior force in a manner as will be described hereinafter, the partition 34 is also caused to move or rotate in association therewith and brought into the position shown by the dot-dash lines to the position shown by the solid lines in the drawings, or vice versa.

Figure 6A:
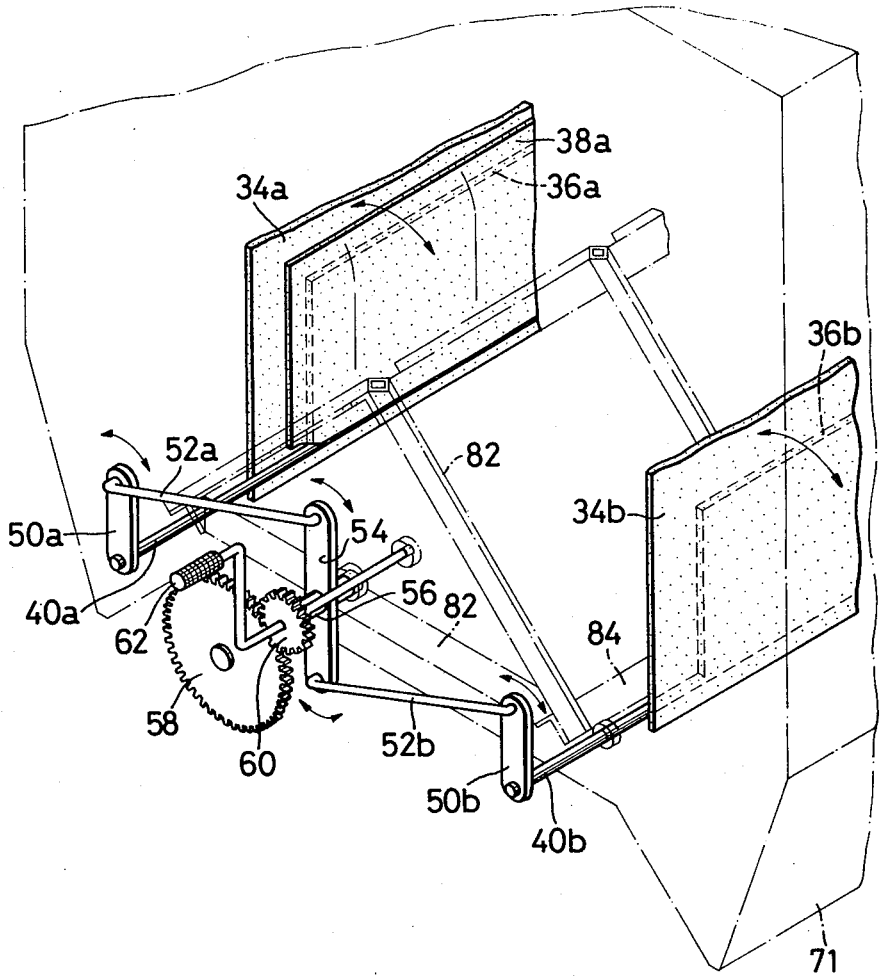
FIGS. 6A and 6B are each a perspective view illustrating the mechanism for driving the partitions.
Figure 6B:
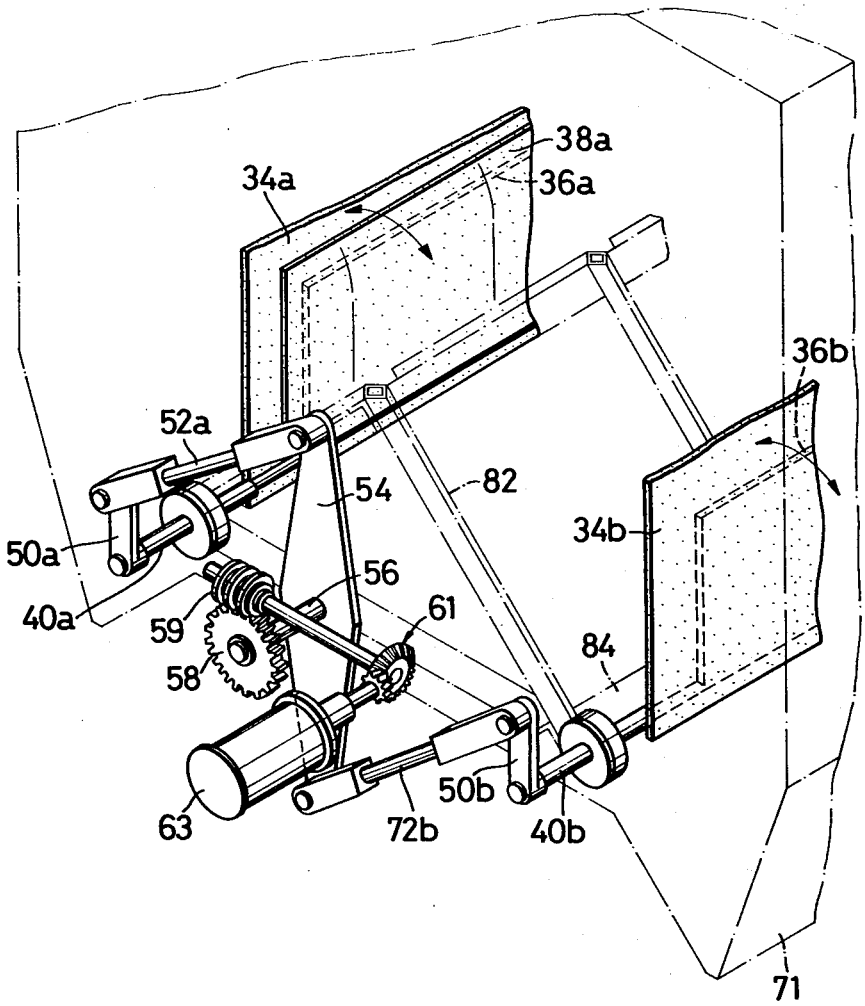

Referring now to FIGS. 6A and 6B, the shafts 40 are rotated by any conventional rotating means, such as a handle 62 as shown in FIG. 6A or a contrarotating motor 63 as shown in FIG. 6B. In instances where the handle 62 is employed to operate the shafts 40 to move the partitions 34 towards predetermined positions, the handle is connected to a gear 60 which in turn is geared to another gear 58. The gear 58 is fixed through a shaft 56 to a rotating lever 54 which in turn is connected to connection rods 52a and 52b. The connection rods are rotatably connected to levers 50a and 50b, respectively. Where the rotating lever 54 is rotated in the clockwise direction by rotating the handle 62 in the counter-clockwise direction, as shown by the arrows in FIGS. 6A, to pull the connection rods, generally referred to as 52, in the direction to the rotating lever, whereby the lever 50a is pulled down in the right-hand direction to rotate the shaft 40a clockwisely, while the lever 50b is pulled down in the left-hand direction to rotate the shaft 40b counter-clockwisely. This operation allows the partitions 34 to be moved towards the central position of the container body so as to render the side compartments wide open. When the handle 62 is rotated in the clockwise direction to rotate the gear 58 in the opposed direction, the rotating lever 54 is also rotated in the counter-clockwise direction, whereby the connection rods 52 push the levers 50 in the outward directions to rotate the shaft 40a in the counter-clockwise direction and the shaft 40b in the clockwise direction. In this case, the partitions 34 are brought into outward positions to form the central compartment 32c where bulk powdered or granular commodities or goods are to be preferably loaded and filled. Turning now to FIG. 6B, the contrarotating motor 63 is seen to operate the partitions 34. The rotation of the partitions 34 can be carried out in substantially the same manner as in the manner in which the handle 62 is operated. In this case, however, the motor 63 is connected to a bevel gear 61 which in turn is connected to a gear 59. The gear 60 is then engaged to the gear 58 which can be operated in the same manner as hereinabove set forth.

Referring back to FIG. 2, the side walls 20 and 22 are hingedly provided at the lower portion thereof with a side bottom panels 70 and 71, respectively, in the lengthwise direction to define the bottom of the compartments 32a and 32b by abutting the free bottom ends thereof to the central bottom plate element 72. The central bottom plate element has a widened M-shaped cross-section and comprises two outwardly sloped side panels 72a and 72b and a V-shaped central panel 72c. That is, the bottom of the compartment 32a is defined by abutting the free end of the side bottom panel 70 to the free end of the side panel 72a of the central bottom plate element when the compartment is loaded and filled with the load. Likewise, the bottom of the side compartment 32b is formed with the side bottom panel 71 and the side panel 72b of the central bottom plate element. The central bottom plate element 72 is provided at the bottom with an outlet 74 for the discharge of the load. In order to facilitate the unloading or emptying of the load, the V-shaped cross-sectional central bottom panel portion 72c may be formed as a quadrangular trapezoidal pyramid having the four inwardly inclined surfaces. With the inclined surfaces around the discharge outlet 74, the load is easily slided downwardly by gravity for discharging.

Turning now to FIGS. 7A and 7B with reference to FIGS. 1 through 4, a frame 80 may be disposed on the top portions of the bottom plate element 72 over substantially the whole length of the container body 10 and may be of a type constructed so as to support the partitions 34 on the outer side portions thereof when the partitions are moved so as to locate at the central portion of the container body. As best shown in FIG. 7A, the frame 80 may be constructed to form a skeletal trigonal prism shape having an inverted V-shaped cross section when mounted on the bottom plate 72. In this case, the frame may be of a metal bar such as steel or stainless steel, having a V-shaped cross section (FIG. 8A) or a hollow diamond-shaped cross-section (FIG. 8B). These shapes serve as smoothly sliding the load downward. The skeletal triangular top and bottom frame portions may be constructed in each case by three short bar elements, generally referred to as 82, and the skeletal side portions of the frame may be formed by assembling three long bar elements, generally referred to as 84, with the short bar elements 82. The side frame portions formed by the long bar elements may be enforced by disposing additional short bar elements, generally referred to as 86, between the pairs of the long bar elements 84 and parallel to the short bar elements 82. Referring further to FIG. 7B, the frame 80 is seen to comprise pairs of flat, curved plate elements, generally referred to as 88, disposed as opposing to each other and standing on the bottom plate 72 and connection bar elements 90 disposed so as to connect the top portions of the plate elements of the pair. The plate element 88 may be further connected to the adjacent plate element or elements by means of a connection element 92. The plate elements 88 may be connected by conventional means such as welding to the top portions of the inner inclined surfaces of the V-shaped central bottom panel portion 72c, as also shown in FIGS. 9 and 10. It is also possible to mount a combination of the pair of the plate elements 88 with the connection elements 90 and 92, as shown in FIG. 7B, on a support (not shown) by welding the bottom end portions of the plate elements thereon.

As have already been described hereinabove, the frame 80 can serve as supporting the partitions 34 by resting them on the side frame portions against the weight of a load when the load is filled in the side compartments 32a and 32b. The frame also serves as providing a sliding slope for the load when it is unloaded. It is also noted that, as the frame is constructed by the inverted V-shaped or diamond-shaped cross sectional bar elements or the thin flat plate elements, the space within and under the frame can also be utilized for loading and it does not adversely affect the unloading of the load.

A description will also be given of the procedures to load bulk powdered or granular commodities or goods into the compartments of the container in accordanc with the present invention.

In instances where bulk powdered or granular commodities such as coal is loaded into the side compartments 32*a* and 32*b*, the handle 62 disposed outside the front or rear wall 16 or 18 of the body 10 is operated so as to have the partitions 34*a* and 34*b* disposed on the sides of the frame 80. That is, as shown in FIG. 6A, the handle 62 is rotated counter-clockwisely to move the partitions 34 in the manner as shown in FIG. 3. In this case, the plate member, generally referred to as 30, is closed, and the coal is loaded through the open top portion 12 of the body 10 into the side compartments 32*a* and 32*b*. The closed plate member 30 serves as distributing the coal into the side compartments disposed at the both sides of the plate member. Although it is possible to load, for example, coal or other bulk powdered load without moving the partitions 34 at the center position of the body, this provides rather small compartments and may present some disadvantages that the partitions enfold the coal. Accordingly, such disadvantages can be prevented by moving the partitions at the central positions prior to loading. It is also to be noted that, as the movement of the partitions 34 may be carried out by mechanical means, the open top portion becomes wide open so that the loading operation is rendered easier and at the same time an operation time for loading can be minimized.

Where the bulk powdered or granular load is unloaded from the side compartments 32*a* and/or 32*b* of the container, the movably hinged panels 70 and/or 71 are opened so that the load is slided downwardly on the sloped or inclined surfaces formed by the partitions 34 supported by the frame 80 and the side panel portions 72*a* and/or 72*b* by gravity. To this end, it is preferred that the sides of the frame 80 and the inclined side panel portions 72*a* and 72*b* are arranged as having a predetermined angle at which the load is easily slided downwardly by gravity.

In instances where goods or commodities, particularly liquid load such as oils is loaded in the central compartment 32*c*, the partitions 34 are moved outwardly as shown in FIGS. 2 and 4 by the operation of the handle 62 or any other conventional means to thereby provide a large space for the central compartment. Thereafter, the cover plate member 30 is opened as shown by the dot-dash lines in FIG. 2, and the liquid load is loaded through the manhole 24 to fill the central compartment defined by the partitions 34 and the central bottom panel portion 72*c* of the bottom plate 72. It is to be noted herein that, as the space provided within the frame 80 is also available for the loading of the goods or commodities, a wider space may be provided in the container according to the present invention, as compared to conventional containers. Where the load filled in the central compartment 32*c* is unloaded therefrom, the discharge outlet 74 is opened and the load is unloaded for example in the gravity discharge system or in the airslide discharge system.

As the construction of the container in accordance with the present invention does not provide any dead space under the frame 80 as opposed to conventional containers, a wider space can be available for the loading of commodities or goods rather than the conventional ones. For example, where the container is applied to a railroad car for goods having a loadage of 30 tons, a conventional railroad car requires the whole length of 13.5 meters, whereas the railroad car having the container in accordance with the present invention requires 11.0 meters. Thus, the present invention can shorten the whole length of a container to a remarkably great extent, as compared to conventional containers having the same loadage. It is further noted that, as the bottom plate element 72 is under the frame 80, the center of the gravity is lowered.

Where the contrarotating motor 63 is employed in place of the handle 62, as shown in FIG. 6B, the operation of the loading and unloading of commodities or goods may be in substantially the same manner as with the operation carried out by the handle.

It should be noted that, as have hereinbefore been mentioned, the present invention should be construed as not limiting to any specific features and embodiments as described hereinabove and as encompassing any modification and variation departing from the spirit and concept of the present invention within the scope of the present invention.

FIGS. 9 and 10 describe another feature embodying the construction of the container in accordance with the present invention.

As shown in FIG. 9 with reference to FIG. 1B, the plate member 100 for distributing the load into the side compartments 32*a* and 32*b* is fixed to the outer sides of the side plate elements 14*b* and 14*c* of the support 14 so as to form a downwardly inclined structure. It is also appreciated that the plate member 30 having an inverted V-shaped cross-sectional structure may be disposed over substantially the whole length of the container body 10 in place of the support 14, and in this case this feature is preferred rather than the mounting thereof to the support 14 because the support will leave some residual load not charged into the side compartments.

In this feature of the container in accordance with the present invention, the partitions 34 are fixed at the top end portions thereof to the inner surfaces of the plate member 30, respectively, and at the bottom end portions thereof to the top end portions of the hingedly movable plates 36, respectively. The both side ends of the partitions 34 are fixed in fluid-tight manner to fastening elements (not shown) formed on the front and rear walls 16 and 18, respectively. The length of the partition 34 may be determined so as to allow the lower portion thereof to bend or hang downward under and below the portion at which the top portions of the hingedly movable plates 36*a* and 36*b* are opposing to each other. In other words, it is preferred to make the length of the partition 34 substantially longer than the distance between the manhole 24 and the top portion of the hinge plate 36 at the position at which the hinge plate rests against the outer surface side of the frame 80. The advantage that the partition is rendered substantially longer than the distance therebetween is that, as shown in FIG. 9, the central compartment 32*c* can provide a wider space for accommodating commodities or goods therein.

FIG. 10 illustrates a further feature embodying the container according to the present invention, in which the partitions 34*a* and 34*b* are situated at the outward positions inflated so as to form a wider space for the central compartment 32*c*. The container is seen herein to have inclined front and rear walls 16 and 18 (not shown) to which the partitions 34 are fixed in fluid-tight manner to the walls by means of mounting elements 102 for mounting the partitions thereto. The mounting elements are securedly fixed in fluid-tight manner to the inner surfaces of the front and rear walls at the side portions 102*a* and 102*b* and to the support 14 by any conventional means.

What is claimed is:

1. A container comprising:

(a) a container body;

(b) a pair of partitions disposed movably in the container body so as to define a central compartment between them and side compartments between each partition and a side of the container;

(c) inlets for each of the compartments formed at the upper portion of the container body, the upper end of each partition being fixed at the upper portion of the container body on opposite sides, respectively, of the inlet for the central compartment;

(d) a central outlet from the central compartment at the bottom of the container body and side outlets from the side compartments at the lower portion of the sides of the container body;

(e) rotatable plates attached, respectively, to the lower end portion of each partition in a fluid-tight manner and each plate being fixed to an associated shaft extending horizontally along the rotatable plate;

(f) means for rotating the shafts to turn the rotatable plates in order to assist the movement of each partition for widening said compartments;

(g) supporting means arranged in the central compartment near the bottom thereof and extending inwardly and upwardly from each side of the central compartment outlet, with said shafts and plates extending along opposite sides of said supporting means so as to rest said rotatable plates thereon and to provide inclined surfaces to easily slide downward commodities or goods to be discharged; said supporting means having openings therein to permit flow of material from said central compartment through to said central outlet and the bottom of the container on each side of said supporting means tapering downwardly and laterally outwardly toward said side outlets.

2. The container as claimed in claim 1 wherein the partitions are of an elastic material.

3. The container as claimed in claim 1 wherein the partitions are constructed so as to bend and hang down between and under the closest facing portions of the rotating means for the partitions at the closed position.

* * * * *